US005603143A

United States Patent [19]

Rucker

[11] Patent Number: 5,603,143

[45] Date of Patent: Feb. 18, 1997

[54] TEMPORARY REPLACEABLE GARMENT FASTENING BUTTON ON A TEAR-A-WAY BACKING AND METHOD

[76] Inventor: Robert L. Rucker, 4930 Fulton St., #201, San Francisco, Calif. 94121

[21] Appl. No.: 282,625

[22] Filed: Jul. 29, 1994

[51] Int. Cl.[6] ..... A44B 1/00

[52] U.S. Cl. ..... 24/90.1; 24/103; 24/104; 24/114.6

[58] Field of Search ..... 24/90.1, 103, 104, 24/105, 106, 114.6, 114.7, 111

[56] References Cited

U.S. PATENT DOCUMENTS

| | | | |
|---|---|---|---|
| 191,649 | 6/1877 | Brookmann . | |
| 194,094 | 8/1877 | Johnson . | |
| 208,753 | 10/1878 | Michelson . | |
| 348,934 | 9/1886 | Swayze . | |
| 1,050,380 | 1/1913 | Nilsson . | |
| 1,239,070 | 9/1917 | Aldridge . | |
| 2,308,412 | 1/1943 | Ballou, Jr. et al. . | |
| 2,380,359 | 7/1945 | Ballou, Jr. . | |
| 2,524,842 | 10/1950 | Slamon | 24/114.7 |
| 2,551,196 | 5/1951 | Ballou, Jr. . | |
| 2,574,014 | 11/1951 | Bryce . | |
| 3,088,295 | 5/1963 | Haines . | |
| 3,416,196 | 12/1968 | Mathison | 24/114.6 |
| 3,720,982 | 3/1973 | Myers et al. | 24/104 |
| 4,471,510 | 9/1984 | DeRosa | 24/90.1 |
| 4,841,604 | 6/1989 | Stevens . | |
| 5,010,625 | 4/1991 | Joyer . | |

FOREIGN PATENT DOCUMENTS

| | | |
|---|---|---|
| 588871 | 6/1947 | United Kingdom . |

*Primary Examiner*—Victor N. Sakran

*Attorney, Agent, or Firm*—Flehr, Hohbach, Test, Albritton & Herbert

[57] ABSTRACT

A method of manufacture and apparatus for a temporary garment fastening button (20) for fastening to a garment (21). The button apparatus (20) includes a garment button (21) having a plurality of holes (25) extending therethrough. A tear-a-way backing patch (26) is provided juxtaposed at a button backside (23), and a plurality of side-by-side securing strands (27) each looping through at least two holes of the plurality of holes (25). Each end of each strand (20) extends through the backing patch (26) to anchor the garment button (22) to the backing patch (26). The backing patch (26) is formed to be torn away from a unitary sheet material (31) which is sufficiently rigid to permit mounting of the button (22) to the sheet material (31) by the strands (27). Further, the sheet material (31) is sufficiently frangible to permit manual tearing of the patch (31) therefrom without severing the strands (27). A clasp device (32) is included for coupling the button (22) to a garment fabric (21).

12 Claims, 2 Drawing Sheets

TEMPORARY REPLACEABLE GARMENT FASTENING BUTTON ON A TEAR-A-WAY BACKING AND METHOD

TECHNICAL FIELD

The present invention relates, generally, to temporary replacement garment buttons and, more particularly, relates to a tear-a-way backing for mounting of the temporary garment fastening button.

BACKGROUND ART

Most people have experienced the loss or unintentional detachment of a garment button from a garment during dressing. This dilemma is particularly troublesome when there is inadequate time to sew or stitch the button back onto the garment. Further, problems of this nature: have become increasingly common as commercial laundries have recently begun using hotter pressing devices that result in breakage of plastic buttons.

Quick fastening buttons have thus been developed which provide a quick remedy for replacing these lost or detached garment buttons without stitching. These devices are typically attached to the garment through locking snap fit clasps which generally require mechanical assistance, such as a hammer, to lock the clasp. The problem with these buttons, however, is that the locking clasps are generally permanently locking and cannot be easily or readily removed from the garment once attached. Typical of these devices may be found in U.S. Pat. No. 194,094.

Another type of quick fastening button has been developed which is capable of being selectively attached to and removed from the garment through a releasable clasping assembly. Hence, these releasable stitch-free buttons can be removed and reused after a permanent replacement button is restitched in place. Patented quick fastening buttons of this type are disclosed in U.S. Pat. Nos. 191,649; 208,753; 348,934; 588,871; 1,050,380; 1,239,070; 2,574,014; 4,841,604 and 5,010,625; and United Kingdom Patent No. 588,871.

To manufacture these quick fastening buttons, a standard button head is typically mounted to one side of clasping assembly which is formed to removably couple to an opposite mating side of the assembly. One problem associated with this manufacturing procedure is that a large majority of these button heads, especially for mens button-down shirts, are the standard two or four hole-type garment buttons which are formed to be stitched to the fabric for mounting by threads. Hence, to simulate this stitched appearance, fictitious or non-functional stitching is stitched to the button head before mounting of the button to the clasping device.

To emulate the stitched appearance, these threads cannot simply be glued or placed in the holes. One approach would be to manually stitch the thread through the holes in the button and then anchor the ends so that the thread will not unravel. This approach, however, tends to be very time and labor intensive since the use of a sewing machine is precluded. Another common approach is to stitch the button to a typical fabric sheet and then cut out the stitched button from the fabric sheet, while leaving a fabric patch upon which the button is sewn. This stitched button is then mounted to the clasp device.

This technique, however, again requires substantial labor since each stitched button must be manually cut away from the fabric sheet through scissors or the like. Moreover, it is important to assure the mounting surface area of the fabric does not extend past the mounting surface area provided by the clasp device for appearance purposes. This added task increases the overall burden of cutting out the fabric patches.

DISCLOSURE OF INVENTION

Accordingly, it is an object of the present invention to provide a temporary garment fastening button apparatus and method for fastening to a garment without requiring stitching.

Another object of the present invention to provide a temporary garment fastening button apparatus and method which can be selectively detached from the garment.

Still another object of the present invention is to provide a method of fabricating a temporary garment fastening button apparatus employing a tear-a-way backing.

Yet another object of the present invention to provide a temporary garment fastening button apparatus and method which simplifies manufacture.

It is a further object of the present invention to provide a temporary garment fastening button apparatus and method which is durable, compact, easy to maintain, has a minimum number of components, and is easy to use by unskilled personnel.

In accordance with the foregoing objects, the invention includes a temporary garment fastening button apparatus for fastening to a garment including a garment button having a frontside and a backside. The button includes a plurality of holes extending therethrough from the frontside to the backside. A tear-a-way backing patch is provided juxtaposed at the button backside, and a plurality of side-by-side securing strands each looping through at least two holes of the plurality of holes. Each end of each strand extends through the backing patch to anchor the garment button to the backing patch. The backing patch is formed to be torn away from a unitary sheet material which is sufficiently rigid to permit mounting of the button to the sheet material by the strands. Further, the sheet material is sufficiently frangible to permit manual tearing of the patch therefrom without severing the strands. The present invention further includes a clasp device formed for coupling to a garment fabric and includes a securing surface having an adhesive for securing the button backside, the backing patch and each strand to the clasp device.

A method for manufacture of a temporary replacement garment button employed to fasten a garment together comprising the steps of: providing a garment button including a base defining a plurality of holes extending therethrough; looping a plurality of side-by-side securing strands through at least two holes of the plurality of holes and extending each end of each strand through a unitary sheet material to anchor the button backside to the sheet material. The method further includes the step of manually tearing away and separating a backing patch portion of the sheet material upon which the garment button and the strands are mounted. The sheet material being sufficiently rigid to permit mounting of the button to the sheet by the strands, and sufficiently frangible to permit the manual tearing of the patch from the sheet material without severing the strands. The method of the present invention further includes securing the button backside, the backing patch and the strands to a clasp device formed for coupling the garment button to a garment fabric.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

FIGS. 3A and 3B are a series of enlarged front elevation views, in partial cross-section, of the garment button of FIG. 1 being manually torn away from a material sheet upon which the garment button is sewn to.

BEST MODE OF CARRYING OUT THE INVENTION

Figure 1:
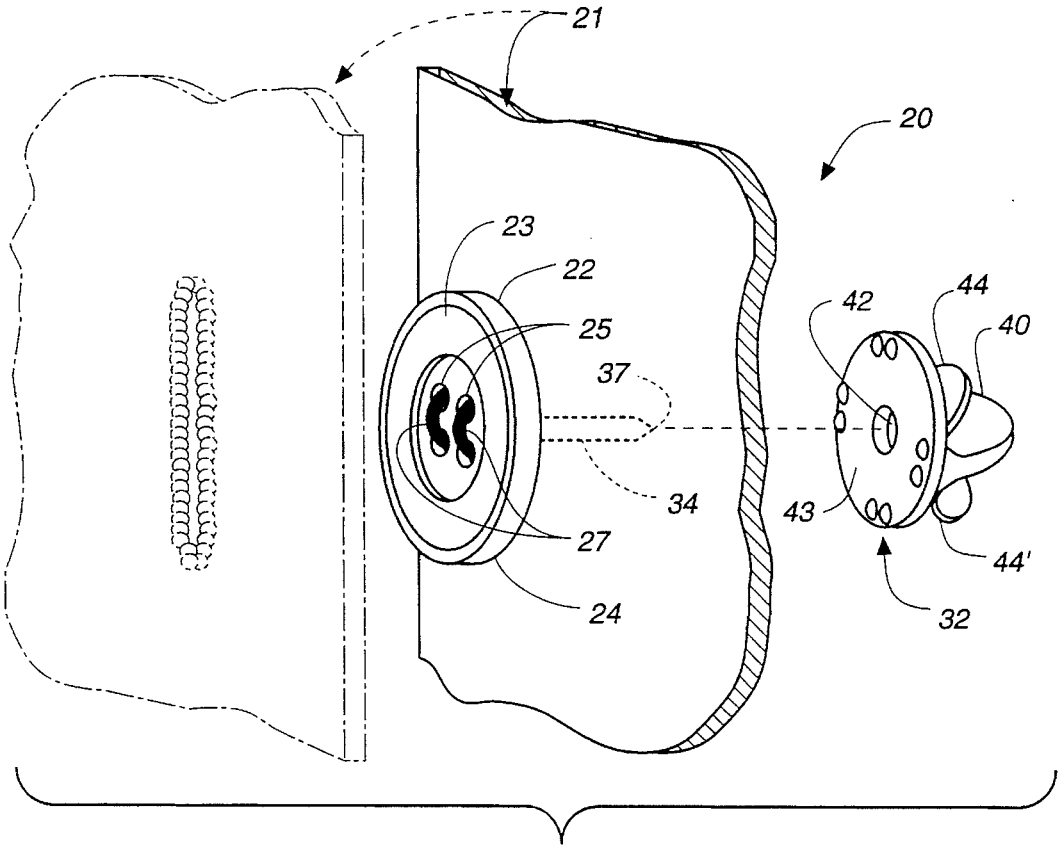
FIG. 1 is an exploded, side perspective view of a garment fastening button for temporary fastening to a garment constructed in accordance with the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
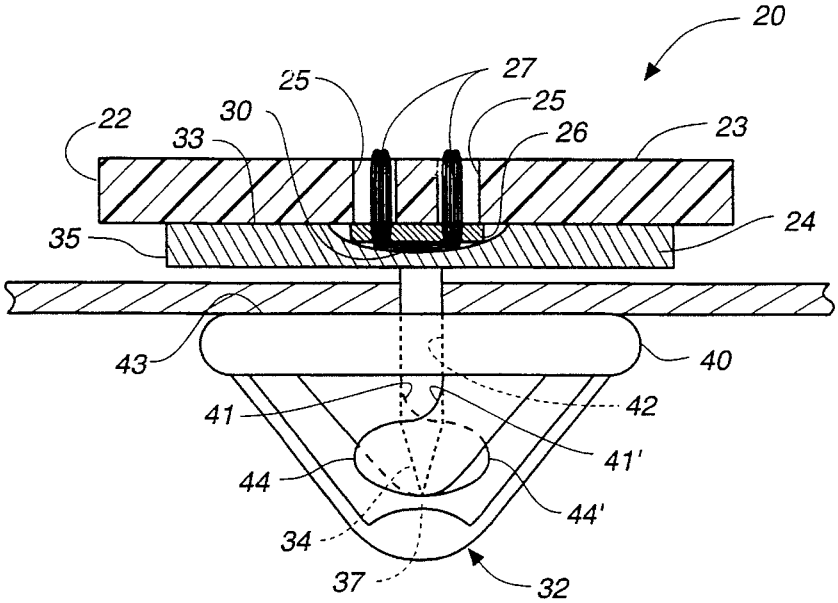
FIG. 2 is an enlarged side elevation view, in partial cross-section, of the garment fastening button of FIG. 1 fastened to a button attaching portion of a garment.

Attention is now directed to FIGS. 1–3 where a temporary garment fastening button apparatus, generally designated 20, is shown for fastening to a garment 21. Briefly, button apparatus 20 includes a garment button, generally designated 22, having a frontside 23 and a backside 24. The button apparatus further provides a plurality of holes 25 extending therethrough from the frontside to the backside. A tear-a-way backing patch, generally designated 26, is juxtaposed to the button backside, and a plurality of side-by-side securing strands 27 each loop through at least two of holes 25. Each end of strands 27 extend through backing patch 26 to anchor garment button 22 to backing patch 26 through a knot 30.

In accordance with the present invention, briefly, garment button 22, the premounted strands 27, the backing patch 26 and the knot 30 are manually torn away or separated from a unitary sheet material 31 (FIG. 3A and 3B), as a unit, which is sufficiently rigid to permit mounting of button 22 thereto by strands 27. Further, sheet material 31 is sufficiently frangible or tearable to permit manual tearing or separation of patch portion 26 from sheet material 31 without severing the strands 27.

The present invention further includes a clasp device, generally designated 32, which is formed for coupling to garment fabric 21. The clasp device includes a securing surface 33 having an adhesive for securing button backside 24, backing patch 26 and strands 27 to the clasp device.

Figure 3A:
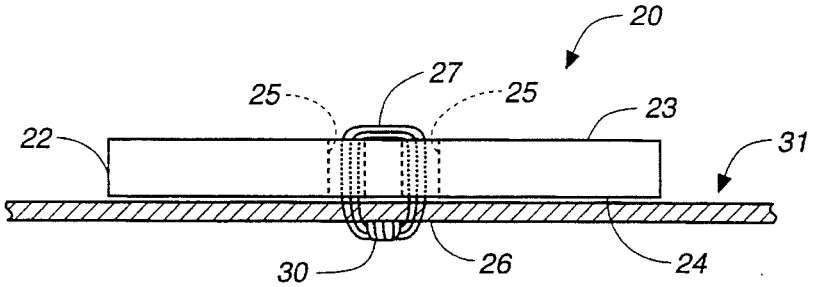

Garment button 22 can be provided by any standard plastic, wood, metal, etc. garment button which is to be normally stitched to a garment. Typically, these standard garment buttons have two, four or six holes extending therethrough for mounting. In accordance with the present invention, FIG. 3A illustrates that button 22 is to be sewn to sheet material 31 preferably through a sewing machine employing standard sewing thread. It will be understood that sheet material 31 must be sufficiently rigid to permit sewing of the threaded strands 27 through holes 25 and through the sheet material 31 where the threads can be pulled taut, and can be knotted on the opposite side thereof for mounting of garment button 22 thereto (FIG. 3A). Thus, threaded strands 27, at least temporarily, have some backing or support upon which button 22 is sewn.

Figure 3B:
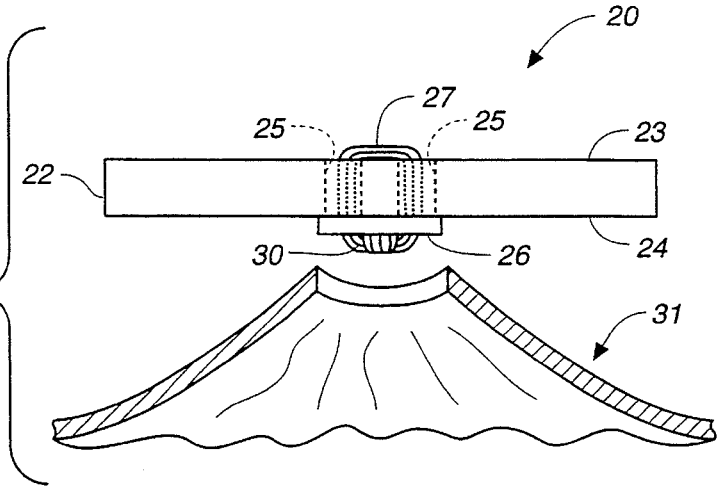

It will be further appreciated, however, that this sheet material must also be sufficiently frangible to allow manual tearing away or separation of patch portion 26 and/or knot 30 from sheet material to permit separation of garment button 22 from sheet material 31. The term "frangible" is meant to describe a property of the sheet material which allows it to be torn or ripped apart without severely damaging or severing the plurality of strands or the knot. That is, the sheet material must not be so rigid as to cause tearing or ripping of the strands or knot 30 during the tearing or separation thereof from the sheet material. Hence, on the frontside of garment button 22, a generally tight stitched appearance is retained (FIG. 3B).

A small patch portion 26 is generally retained by thread strands 27 after separation from sheet material 31. In some instances, however, the knot, the strands and the button will be fully separated from sheet material 31 and from patch portion 26 so that knot 30 and strands 27 are free of mounting to substantially any fabric structure. It will be understood that this will not affect the tautness of the strands nor the ability to mount to clasp device 32. The sheet material is mainly only provided for support to initially affix the plurality of strands to the garment button, while, subsequently, permitting the stitched button to be separated or torn therefrom.

In accordance with the present invention, sheet material 31 is preferably provided by a light weight fabric such as fabric interlining or interfacing used to strengthen fabric. Further, this arrangement permits a plurality of garment buttons to be sewn to the sheet material at one time in an array or the like (not shown) which then are torn or separated from sheet material 31 as needed. Accordingly, the present invention provides a temporary garment fastening button having the appearance of a stitched button which can be easily manufactured and assembled without the complications presented by the prior art stitched appearance button apparatus. This technique, hence, is less labor intensive which improves efficiency and reduces costs.

Figure 4:
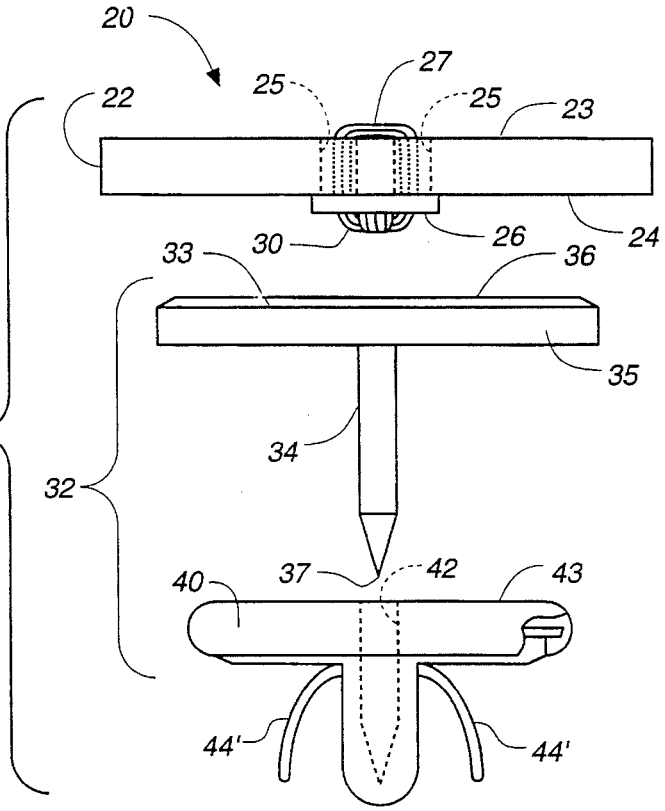
FIG. 4 is an exploded, front elevation view of the stitched garment button being mounted to the clasp device.

Subsequently, as shown in FIGS. 2 and 4, these stitched appearance garment buttons are secured to clasp device 32 so that they can be mounted to a garment fabric. One important aspect of the present invention is the ability of the button apparatus to be manually removed from the garment since the present invention preferably only provides temporary relief for a lost or detached button. Accordingly, clasp device 32 must be capable of being manually released from a piercing shank 34 so that it can be withdrawn from engagement with the garment. Subsequently, time permitting, the original garment button may be stitched back onto the garment.

Although other clasp devices may be suitable, the present invention preferably employs a clasp device already known in the field, and is thus, not structurally claimed as a novel aspect of the present invention. In the preferred embodiment, the securing device employed is similar to those disclosed in U.S. Pat. Nos. 2,380,359 and 2,551,196 to Ballou, Jr., et al.

Briefly, however, FIG. 4 illustrates that clasp device 32 includes a disk portion 35 providing a planar securing surface 33 upon which button backside 24 is to supportably mount. Disk portion 35 is preferably composed of a thermoplastic material or the like. To secure garment button 22 to clasp device 32, an adhesive 36 is applied or interposed between securing surface 33 and button backside 24 which causes adherence therebetween. This adherence sandwiches strands 27, knot 30 and patch portion 26 therebetween to further secure the same to garment button 22.

A piercing shank 34 of clasp device 32 extends rearwardly from disk portion 35 and away from button backside 24. Piercing shank 34 is a needle-like member having a piercing end 37 formed to pierce through garment fabrics. The length of the piercing shank must be sufficient to extend through the garment fabric and beyond a rear side thereof. While the piercing shank is preferably composed of a metallic material, it will be understood that it could be composed of other rigid materials such as plastics, ceramics or the like.

A gripping member of clasp device 32 is formed to releasably interengage piercing shank 34 to secure the garment button to the garment fabric (FIGS. 2 and 4). Gripping member 40 includes a pair of manually adjustable jaws 41, 41' which are formed to be selectively attached to or detached from piercing shank 34 for mounting or releasing, respectively.

Once piercing shank 34 has pierced the garment fabric, the piercing end 37 of shank 34 can be inserted into aperture 42 (FIG. 1) formed in a seating surface 43 of gripping member 40. As piercing shank 34 is manually forced further into gripping member 40, piercing shank 34 engages the pair of resilient gripping jaws 41, 41' for releasable gripping thereto.

To remove clasp device 32 from engagement with the shank, each gripping jaw 41, 41' includes a latch lever 44, 44' which, when manually engaged and pushed together, spread gripping jaws 41, 41' apart. This motion widens the distance between the two opposing gripping jaws 41, 41' so that the clasp device can be withdrawn from the shank. Subsequently, the button can be removed from the garment.

Accordingly, the temporary garment fastening button of the present invention can be selectively installed and removed from the garment, and is, further, extremely simple to operate.

From the description of the present apparatus, it will be understood that the method for manufacture of a temporary replacement garment button of the present invention includes the steps of: A) providing a garment button 22 defining a plurality of holes 25 extending therethrough from frontside 23 to backside 24 thereof; and B) looping a plurality of side-by-side securing strands 27 through at least two holes of said plurality of holes 25. Each end of each strand 27 extending through a unitary sheet material 31 to anchor button backside 24 in a knot 30 to sheet material 31. The present invention further includes the step of C) manually tearing away and separating knot 30 from sheet material 31 upon which garment button 22 and strands 27 are to be mounted. As mentioned, sheet material 31 is sufficiently rigid to permit mounting of button 22 thereto by strands 27, and is sufficiently frangible to permit the manual tearing of knot 30 from sheet material 31 without severing strands 27. The last step includes D) securing button backside 24, knot 30 and strands 27 to a clasp device 32 formed for coupling garment button 22 to garment fabric 21.

Additionally, in the present method, the looping step is accomplished by sewing strands 27 through button holes 25 and sheet material 31 using a sewing machine (not shown). Further, the securing step is accomplished by applying an adhesive 36 between a securing surface 33 of clasp device 32 and button backside 24.

What is claimed is:

1. A temporary garment fastening button apparatus for fastening to a garment, said button apparatus comprising:

a garment button having a frontside and a backside, and defining a plurality of holes extending therethrough from said frontside to said backside;

a tear-a-way backing patch juxtaposed at the button backside;

a plurality of side-by-side securing strands each looping through at least two holes of said plurality of holes and each end thereof extending through said backing patch to anchor said garment button to said backing patch, said backing patch being formed from a unitary sheet material sufficiently rigid to permit mounting of said button thereto by said strands and sufficiently frangible to permit manual tearing and release of said button from said sheet material without severing said strands; and a clasp device formed for coupling to a garment fabric and including a securing surface having an adhesive for securing the button backside and said strands to the clasp device.

2. The button apparatus as defined in claim 1 wherein, said strands comprise sewing thread.

3. The button apparatus as defined in claim 1 wherein, said backing patch and said sheet material comprises a fabric interlining.

4. The button apparatus as defined in claim 1 wherein, said backing patch and said sheet material comprises paper.

5. The button apparatus as defined in claim 1 wherein, said clasp device includes a piercing shank extending rearwardly away from said button backside and is formed to pierce through a front side of said garment fabric and beyond a rear side thereof, and a releasable gripping member having gripping jaws formed to removably grip said piercing shank extending through said garment, said gripping jaws being manually releasable to release said gripping member from said piercing shank.

6. A method for manufacture of a temporary replacement garment button employed to fasten a garment together, said method comprising the steps of:

providing a garment button defining a plurality of holes extending therethrough from a frontside to a backside thereof;

looping a plurality of side-by-side securing strands through at least two holes of said plurality of holes and extending each end of each strand through a unitary sheet material to anchor the button backside in a knot to said sheet material, said sheet material being sufficiently rigid to permit mounting of said button thereto by said strands and sufficiently frangible to permit manual tearing of one of: (i) said knot from said sheet material and (ii) a backing patch including said knot from said sheet of material, without severing said strands;

manually tearing away and separating said garment button from said sheet material upon which said garment button and said strands are mounted; and securing the button backside, said knot and said strands to a clasp device formed for coupling said garment button to a garment fabric.

7. The method as defined in claim 6 wherein, said sheet material includes a backing patch portion, upon which said strands and said knot are affixed, which is torn away from said sheet material with said garment button to provide additional support to said strands and said knot.

8. The method as defined in claim 6 wherein, said securing step is accomplished by applying an adhesive between a securing surface of said clasp device and said button backside.

9. The method as defined in claim 6 wherein, said looping step is accomplished by sewing said strands through the button holes and said sheet material.

10. The method as defined in claim 9 wherein, said sewing step is accomplished by a sewing machine.

11. The method as defined in claim 6 further including the step of:

piercing a piercing shank of said clasp device extending rearwardly from the button backside through a front side of said garment and beyond a rear side thereof; and releasably mounting a gripping member to said piercing shank for removably securing said garment button to said garment, said clasping device including gripping jaws formed to removably grip said piercing shank extending through said garment, said gripping jaws being manually releasable to release said gripping member from said piercing shank.

12. The method as defined in claim 6 further including the step of:

releasing said securing device from said piercing shank by manually parting said gripping jaws from gripping contact with said shank.

* * * * *